US006435990B1

(12) United States Patent
Bradley

(10) Patent No.: US 6,435,990 B1
(45) Date of Patent: Aug. 20, 2002

(54) BATTING SKILLS TRAINING DEVICE

(76) Inventor: Curtis C. Bradley, 27 Talladega St., Monroeville, AL (US) 36460

( * ) Notice: Subject to any disclaimer, the term of this patent is extended or adjusted under 35 U.S.C. 154(b) by 0 days.

(21) Appl. No.: 09/553,565

(22) Filed: Apr. 20, 2000

Related U.S. Application Data

(60) Provisional application No. 60/130,793, filed on Apr. 23, 1999.

(51) Int. Cl.[7] ..... A63B 69/00

(52) U.S. Cl. ..... 473/453; 473/415; 473/422; 473/429

(58) Field of Search ..... 473/417, 419, 473/422–425, 426–430, 453, 454, FOR 102, FOR 103, FOR 104; 273/407; 482/109, 118, 122; 434/247

(56) References Cited

U.S. PATENT DOCUMENTS

| | | | | |
|---|---|---|---|---|
| 3,386,733 A | | 6/1968 | Russo et al. | |
| 3,475,026 A | * | 10/1969 | Cooper | 473/430 |
| 3,550,938 A | * | 12/1970 | Cunningham, Jr. | 473/429 |
| 3,937,464 A | * | 2/1976 | Zalewski | 473/428 |
| 3,940,131 A | * | 2/1976 | St. Claire, Jr. | 473/417 |
| 3,948,517 A | * | 4/1976 | Feiler | 473/429 |
| 4,451,036 A | | 5/1984 | Sinclair et al. | |
| 4,516,771 A | | 5/1985 | Nau | |
| 4,533,138 A | * | 8/1985 | Rodrigues, Jr. et al. | 273/407 |
| 4,655,452 A | * | 4/1987 | Huerstel | 473/453 |
| 4,783,070 A | | 11/1988 | Bauer et al. | |
| 5,226,645 A | * | 7/1993 | Steward | 473/453 |
| 5,478,070 A | | 12/1995 | Morrison | |
| 5,505,443 A | * | 4/1996 | Padilla | 473/430 |
| 5,711,726 A | * | 1/1998 | Powers | 473/453 |

* cited by examiner

*Primary Examiner*—Paul T. Sewell
*Assistant Examiner*—Mitra Aryanpour
(74) *Attorney, Agent, or Firm*—Brinks Hofer Gilson & Lione

(57) ABSTRACT

A training device for improving the batting skills of a baseball player constructed of two parallel bars that are held apart by a pair of U-shaped arms such that an open space is created between the parallel bars. The location of the arms relative to the parallel bars can be changed to accommodate either right or left handed hitters. The arms space the parallel bars apart sufficiently to create an open space between the arms through which a swung baseball bat can slide. The interior facing surfaces of the bars each have a series of rubber or plastic teeth that protrude therefrom. These rubber or plastic teeth function to prevent damage to the bat when it is swung through the open space and also to cushion the impact on the student's hands if the swing is not level. A baseball is teed up at the end of the open space on the lower of the two bars. The lower bar has a swivel attachment with the upper end of the stand. The swivel attachment permits the open space between the bars to be level or parallel to the ground and thus will permit a baseball bat to smoothly pass through only if the bat has been swung in a level plane. The plastic stand is formed from a pair of telescoping tubes which permits height adjustable to accommodate students of various heights. The cup holder or tee on which the ball rest can be adjustable in height and mounted on a resilient base.

6 Claims, 1 Drawing Sheet

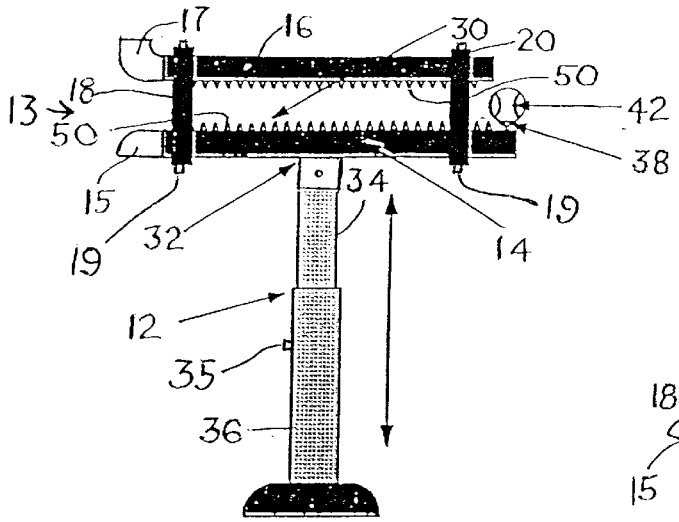
FIG 1
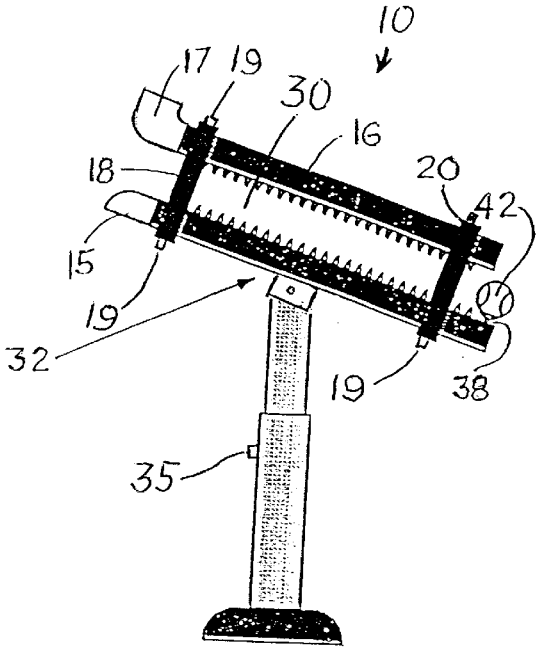
FIG 2
FIG 3
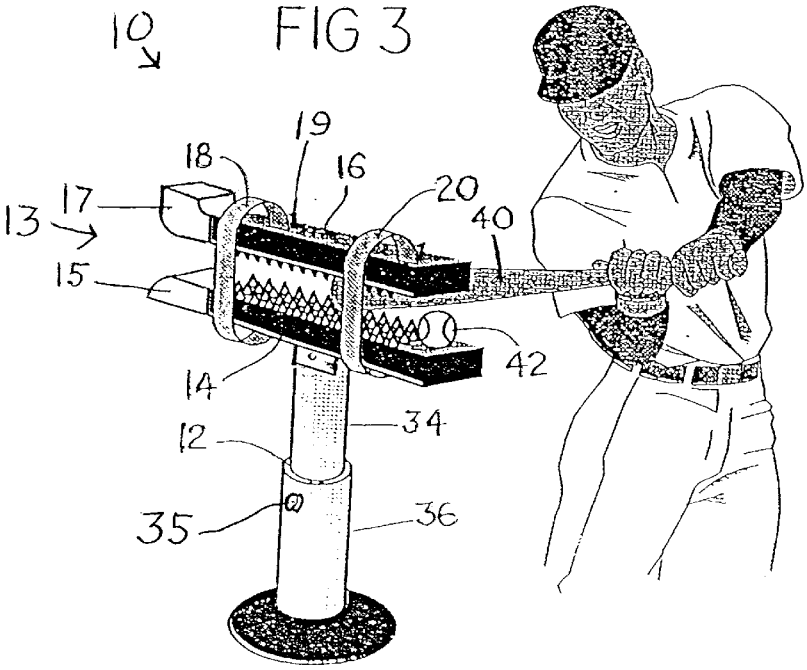

BATTING SKILLS TRAINING DEVICE

This application claims priority from provisional application Ser. No. 60/130,793, filed Apr. 23, 1999.

BACKGROUND OF THE INVENTION

This invention relates to a device for improving a baseball player's batting skills and enabling the player to develop their skills by repetitively practicing his or her swing. More particularly this invention relates to a light weight, low mass, economically priced device that can be easily transported and set up for use. Although the structure of this invention is light weight, has a low mass and is economically priced it can withstand being struck by a baseball bat without being damaged. It is also an important feature of this invention that when the training device is struck by a baseball bat, that has missed its target, the training device will offer little resistance to being knocked over. As a result when the player makes a bad swing he or she is not punished by the bat coming to an abrupt stop and stinging their hands.

There have been many attempts to provide training devices to assist baseball players to improve their skills, especially their hitting skills. The following are examples of such devices.

The Morrison U.S. Pat. No. 5,478,070 discloses a trainer tee that creates a target zone that guides a bat, swung by a player toward a ball placed at a fixed elevated position above the ground.

The Steward U.S. Pat. No. 5,226,645 discloses a baseball trainer device that is intended to increase the power of a player's baseball swing.

The Nau U.S. Pat. No. 4,516,771 discloses a batting practice device for aiding a batsman to perfect his swing including a pair of elongated, vertically spaced, tubular arms that are resiliently mounted at one end to a mounting plate.

The Sinclair et al U.S. Pat. No. 4,451,036 discloses a batting practice device comprising a support post with a target apparatus mounted on its upper portion. The target apparatus includes a pair of arms that extend outwardly from the post. A guide frame is mounted on the free end of each arm and a plurality of flexible elements extend into the strike zone to provide resistance to a swung bat passing through the strike zone.

The patent to Russo et al U.S. Pat. No. 3,386,733 discloses a batting practice impact device including an upper and lower yieldable elongated rubber elements that taper toward their free ends. The upper and lower yieldable elongated elements are mounted such that their free ends overlap and the swung bat can spread the overlapped ends apart.

BRIEF SUMMARY OF THE INVENTION

The purpose of this invention is to provide a device that can be used to aid in the development of correct baseball batting skills. The uniquely effective design of this invention, its simplicity, ease of use, adaptability, and cost-effectiveness results in a significant advancement over the prior art devices. The device has a simple design and a minimum number of parts. The training device is made from light weight plastic and rubber which enables the training device to be easily transported by even a young child. Furthermore, the simplicity of the design enables a small child to set it up for use without the aid of an adult. A very important feature of this invention is that in the event that the player completely misses the target zone and strikes a solid portion of the training device, the light weight and low mass of the training device will permit it to be knocked over without stinging the players hands. This is very important because such a complete miss of the target zone is most likely to occur when the player is first introduced to the training device and if he or she has a bad experience further use of the training device will not be pursued. Through the use of this invention a student baseball players can learn proper batting techniques such as stance, swing, visual discrimination, eye-hand coordination, point of impact and follow-through. All of this can be practiced and learned without the need of a pitcher, catcher, or outfielder to retrieve balls. The invention can be used as a teaching aid for a coach in formal instructional situations as well as for individual practice at a ball field or at home. The invention can be used in combination with a video camera to perform swing analysis studies. Furthermore, the invention is adjustable to accommodate people of different heights, it is easy to assemble and is compact to store.

All of the above discussed prior art devices have a large number of heavy metal parts some of which must be machined. These device would be heavy, expensive to produce, difficult to transport, complex to set up and would be a hazard to a player if the swing was not in the target zone.

BRIEF DESCRIPTION OF SEVERAL VIEWS OF THE DRAWINGS

FIG. 1 is a side view of the training device that has been set up for a right handed hitter to practice a level swing.

FIG. 2 is a side view of the training device that has been set up for a right handed hitter to practice a downwardly inclined swing.

FIG. 3 is a perspective view of the training device with a student in the process of swing at a ball held on the training device.

DETAILED DESCRIPTION OF THE INVENTION

The invention includes a plastic stand 12 for mounting the training device 10. The training device 10 comprises two parallel bars 14, 16 held apart by a pair of C-shaped arms 18, 20. The location of the arms relative to the parallel bars can be changed to accommodate either right or left handed hitters. The arms 18, 20 space the parallel bars apart sufficiently to create an open space 30 between the arms through which a swung baseball bat 40 can slide. A top guide member 17 is attached to the leading edge of parallel bar 16 at the end of the open space 30 where the bat 40 enters. A bottom guide member 15 is attached to the leading edge of parallel bar 14 such that it is spaced from and below top guide member 17. The guide members 17 and 15 are made from flexible material such as hard rubber and function to absorb shock should the bat 40 be mis-guided and not be centered with the open space 30. A baseball 42 is teed up at the end of the open space 30 on the lower 14 of the two bars. The lower bar 14 has a swivel attachment 32 with the upper end of the stand 12. Swivel attachment 32 allows the open space 30 between the bars 14, 16 to be level or parallel to the ground and thus will permit a baseball bat to pass through the open space 30 only if the bat has been swung in a level plane. Thus, when the open space is adjusted parallel to the ground the training device 10 will teach the student to develop and practice a more precise and level bat swing. As best illustrated in FIG. 2, the swivel attachment 32 also allows the training device 10 to be secured at a position at which the open space 30 is at an angle to the ground.

The plastic stand is formed from a pair of telescoping tubes 34, 36 which permits height adjustable to accommodate students of various heights. Locking mechanisms are provided to secure the telescoping tubes 34, 36 in a desired position. The lower bar 14 is slightly longer than the upper bar 16 to accommodate a cup holder or tee 38 upon which the baseball 42 rests. The cup holder or tee 38 can be adjustable in height and mounted on a resilient base. The pair of C-shaped arms 18, 20 include quick-connect fasteners 19 that enable them to be easily and quickly changed from one side of the bars 14, 16 to the other to convert the training device 10 from a left handed hitter to a right handed hitter or vice versa. The arms 18, 20 are sized and configured to space the bars 14, 16 approximately 4 to 5 inch apart. The vertical portions of arms 18 and 20 are located such that they allow the end of the bat to extend 6 to 7 inches beyond the center of the baseball. As a result, when the bat 40 extends the maximum distance through the open space 20, the ball 42 will strike the bat on what is called the "sweet spot" of the bat 40. When the "sweet spot" is struck, a maximum impact is imparted to the ball and the batter feels a minimum shock from the bat. The interior facing surfaces of the bars 14, 16 each have a series of rubber or plastic teeth 50 that protrude from the inner surfaces of the bars 14,16. These series of rubber or plastic teeth function to prevent damage to the bat when it is swung through the open space 30 and also to cushion the impact on the student's hands if the swing is not accurate. A small cup or tee 38 is mounted on the free end of the lower bar 14 for the reception of the ball 42. This properly locates the ball 42 to be hit when the bat is swung through the open space 30. The swivel mounting mechanism 32 for the lower bar to the stand allows the lower bar to swivel or be adjusted such that it can be inclined to the horizontal.

In FIG. 2 the pair of bars 14, 16 has been swiveled and locked about swivel mounting mechanism 32 such that the baseball bat must be swung at a downward sloping angle in order to hit the baseball.

To use the training device the student would set up the bars 14, 16 for either left or right handed hitting, adjust the height by sliding and locking the telescoping tubes 34, 36 and adjusting the inclination of the bars 14, 16 to match his or hers individual bat swing characteristics. The student would then place a ball 42 on the holding cup 38 at the end of the lower bar 14. As best shown in FIG. 3, the student could then enjoy the benefit of being able to practice and develop their swing into one that would have a consistent and even path of travel each and every time that they swing. In addition to developing a consistent and even swing the student is also practicing controlling his or her swing such that it is within the center of the open space and rather than striking the rubber or plastic teeth 50 and thus improves the accuracy of their swing. As a result of using this training device to improve their swing the student can substantially improve their batting average.

The foregoing specification describes only preferred embodiments of the invention as shown. Other embodiments besides the ones described above may be articulated as well. The terms and expressions therefore serve only to describe the invention by example only and not to limit the invention. It is expected that others perceive differences which while differing from the foregoing, do not depart from the spirit and scope of the invention herein described and claimed.

What is claimed is:

1. A batting practice device, comprising:

a mounting stand including telescoping tubes and a locking mechanism to permit vertical adjustment of the mounting stand, said mounting stand having an upper end;

a bat guide assembly secured to said upper end of the mounting stand;

said bat guide including a pair of parallel bars having first and second ends, said parallel bars being joined by a plurality of C-shaped arms that maintain said parallel bars in a spaced apart parallel relationship to thus provide an open space there between, said open space being unobstructed at both the first and second ends of the parallel bars to permit a ball bat to enter the open space at one end and exit the open space at the other end, said C-shaped arms including quick-connect fasteners for connecting them to said parallel bars to thus enable the C-shaped arms to protrude from either side of the parallel bars and thus accommodate either right or left handed batters;

a tee adapted to hold a ball, supported by one of said parallel bar, located within said open space;

flexible teeth carried by the surfaces and extending along the lengths of said parallel bars that define said open space, said flexible teeth functioning to protect the bat and cushion the impact on the batters hands if the bat strikes the parallel bars; and said flexible teeth extending normal to the surfaces of said parallel bars such that they project into said open space.

2. A batting practice device as set forth in claim 1 wherein said bat guide assembly is connected to the upper end of said mounting stand by a swivel attachment.

3. A batting practice device as set forth in claim 1 wherein guide members are connected to the ends of said parallel bars at the end at which the bat will enter said open space to guide said bat into said open space.

4. A batting practice device as set forth in claim 1 wherein said cushions are formed of flexible teeth.

5. The batting practice device as set forth in claim 3 wherein said guide members are formed from flexible material.

6. A batting practice device as set forth in claim 2 wherein guide members are connected to the ends of said parallel bars at the end at which the bat will enter said open space to guide said bat into said open space.

* * * * *